United States Patent [19]

Hippocrates

[11] Patent Number: 4,898,525

[45] Date of Patent: Feb. 6, 1990

[54] MOTOR, PUMP AND FLOW METER WITH A PLANETARY SYSTEM

[76] Inventor: Exarchou Hippocrates, Iroon Polytechniou I, Larisa, Greece

[21] Appl. No.: 227,005

[22] Filed: Aug. 1, 1988

[30] Foreign Application Priority Data

Apr. 27, 1988 [GR] Greece ..... 880100274

[51] Int. Cl.[4] ..... F01C 1/26

[52] U.S. Cl. ..... 418/227; 123/247

[58] Field of Search ..... 418/58, 227, 61.1; 73/253, 255, 260; 123/247

[56] References Cited

U.S. PATENT DOCUMENTS

| | | | |
|---|---|---|---|
| 1,279,912 | 9/1918 | Roberts | 418/227 |
| 2,181,962 | 12/1939 | Booth | 418/227 |
| 2,694,983 | 11/1954 | Farrell | 418/227 |
| 3,330,215 | 7/1967 | Yamane | 418/227 |
| 3,363,606 | 1/1968 | Robertson | 418/227 |
| 4,384,832 | 5/1983 | Horst | 418/227 |
| 4,741,308 | 5/1988 | Ballinger | 418/227 |

FOREIGN PATENT DOCUMENTS

| | | | |
|---|---|---|---|
| 423545 | 1/1926 | Fed. Rep. of Germany | 418/227 |
| 2235607 | 1/1975 | France | 418/227 |

*Primary Examiner*—John J. Vrablik

[57] ABSTRACT

A planetary system, mounted within a housing, is the basis of manufacturing a motor, a pump, or a fluid flow meter. The housing is provided with an inlet and an outlet. The planetary system comprises: a cylindrical core (1) and its axis (2), two discs (9) mounted on the two bases of the core, the planets (4) rotated into special circular recesses of the core, and the transmission system (gears 11–14) giving motion to the planets. When a motor is used to rotate the shaft (2), the planetary system is converted into a pump since it sucks (depending on the supply) air or liquid from the inlet and discharges the same under pressure at the outlet. When on the other hand the inlet of the planetary system is connected to a duct containing a fluid under pressure, the planetic system is converted into a flow meter or a hydraulic motor or a gas motor, for liquids or gases respectively. If as depicted in FIG. 6 a valve is mounted at the inlet, a petrol-air mixture at a certain proportion being introduced through this inlet, being consequently ignited via a special spark plug (7), whereby heat is developed and the heat gases push the planet to the discharge. This motion when repeated finally provides mechanical energy to the shaft (2) which is forced to rotate, thereby resulting to a motor. Further accessories of lubrication, cooling, distribution and supply of electric current, etc. are necessary, as well.

8 Claims, 5 Drawing Sheets

MOTOR, PUMP AND FLOW METER WITH A PLANETARY SYSTEM

The invention relates to the construction of a machine with rotating planets, which will be thereafter briefly call P.S., where this machine can, following certain minor additions or amendments, be used as:

a. Liquid or gas pump b. Fluid flow meter c. Hydraulic motor or Gas motor, and d. Rotary internal combustion motor (petrol operated)

Various such types of machinery may be commerically found, being based on different operation principles, such as for example piston, centrifugal, propeller or ROOTS type pumps, etc. Each pump type has its own advantages and disadvantages provides an optimum performance under various working conditions which makes it preferable amongst other types of pumps.

The new machine, described hereinafter is based on an entirely new methodology. Its advantages, which might only become evident in practice, will be compared to certain types of corresponding presently available machinery, since it is impossible to give a lengthy description in view of the limited space available.

DESCRIPTION OF THE PLANETIC SYSTEM (P.S.)

Figure 4:
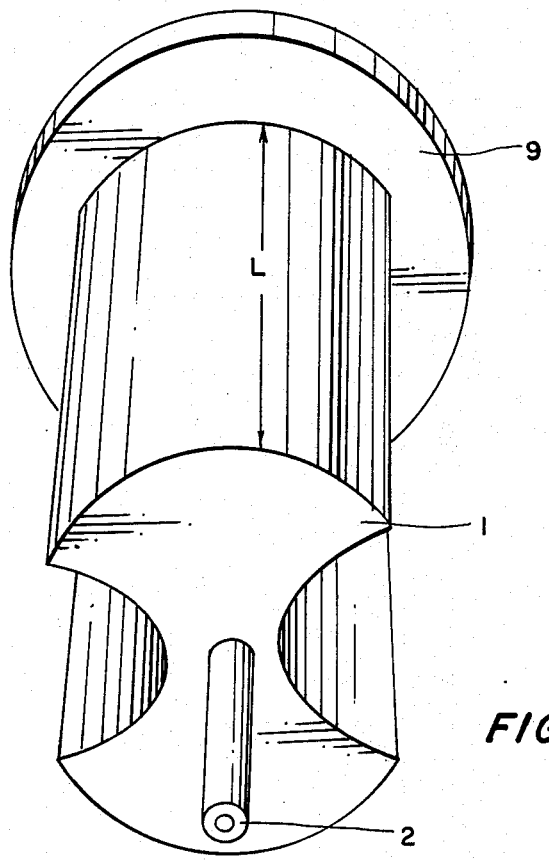
FIG. 4, is showing the cylindrical core (1) with its shaft (2) and one disc (9) mounted in one of its base.

Its basic parts illustrated in the attached drawings, are the following:

1. The core 1 is a cylinder of radius R, where one or two semicircular portions of radius r of the same length L (FIG. 4) are cut out of core 1, thereby creating the space within which rotate the planets, as described hereinafter. Furthermore in order to reduce the weight of the core 1, it is possible to allow for void spaces in its interior.

2. The discs 9 or radius R' and thickness corresponding to the specific requirements. These are bolted onto the two basements of core 1 and rotate together around the same shaft 2.

Figure 5:
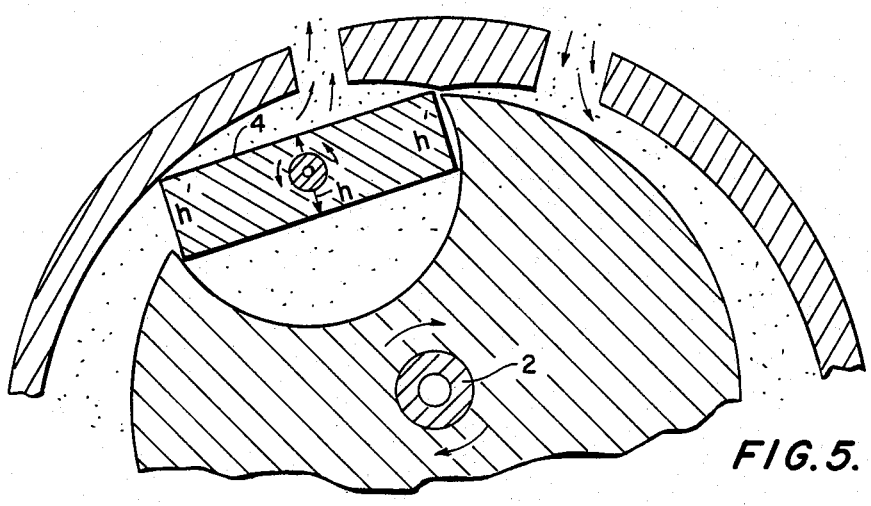
FIG. 5, is a cross section view of the planetic system showing in details the shape of a planet.

3. The Planets 4. One or two and rarely more planets are used depending on each particular case, each rotating around the shaft 8, whose both ends are based on the corresponding discs. The centre of the shaft 8 passes through the middle of the chord of the semicircular portion which was removed from the core 1. The shape of the planets is shown in FIG. 5 in a cross sectional view normal to their axis as shown in FIG. 5. In this Figure, we observe that the width of the planet is rduced as we proceed from the centre outwards to the circumference. Thus the ratio h':h becomes approximately 14.61:15.20 mm, when r=26.5 and R=50.0 mm. The planets perform two simultaneous movements. One movement around the axis 2 together with the core and one self rotation around its own axis 8 which is parallel to axis 2. The second movement is performed via the following system:

4. System for the transmission of motion to the Planets

This system aims to transfer the motion of the axis 2 to the axes of the planets in such a way that each rotation of the planet around the axis 2 of the core 1 results to half a rotation of the planet 4 around its own axis 8 and in particular in the opposite direction. That is, when the core moves in a clockwise direction, the planets must rotate in a counter-clockwise direction around their own axis. The opposite might happen as well.

Figure 2:
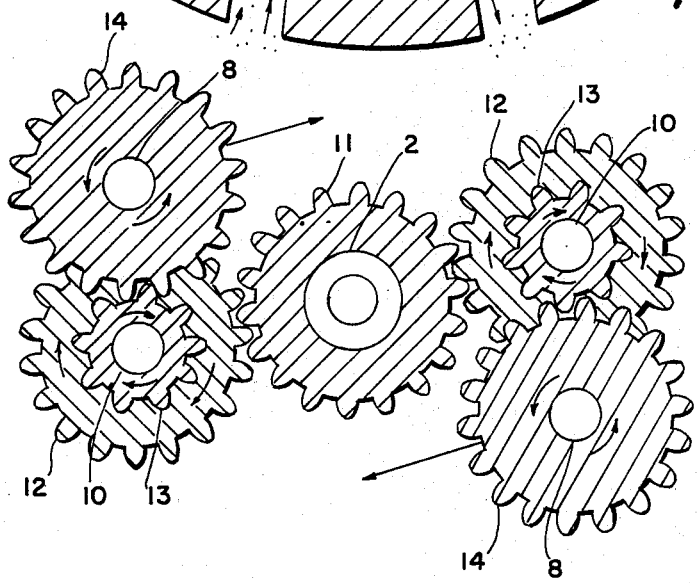
FIG. 2, is a cross section view of the transmission system of motion.
Figure 3:
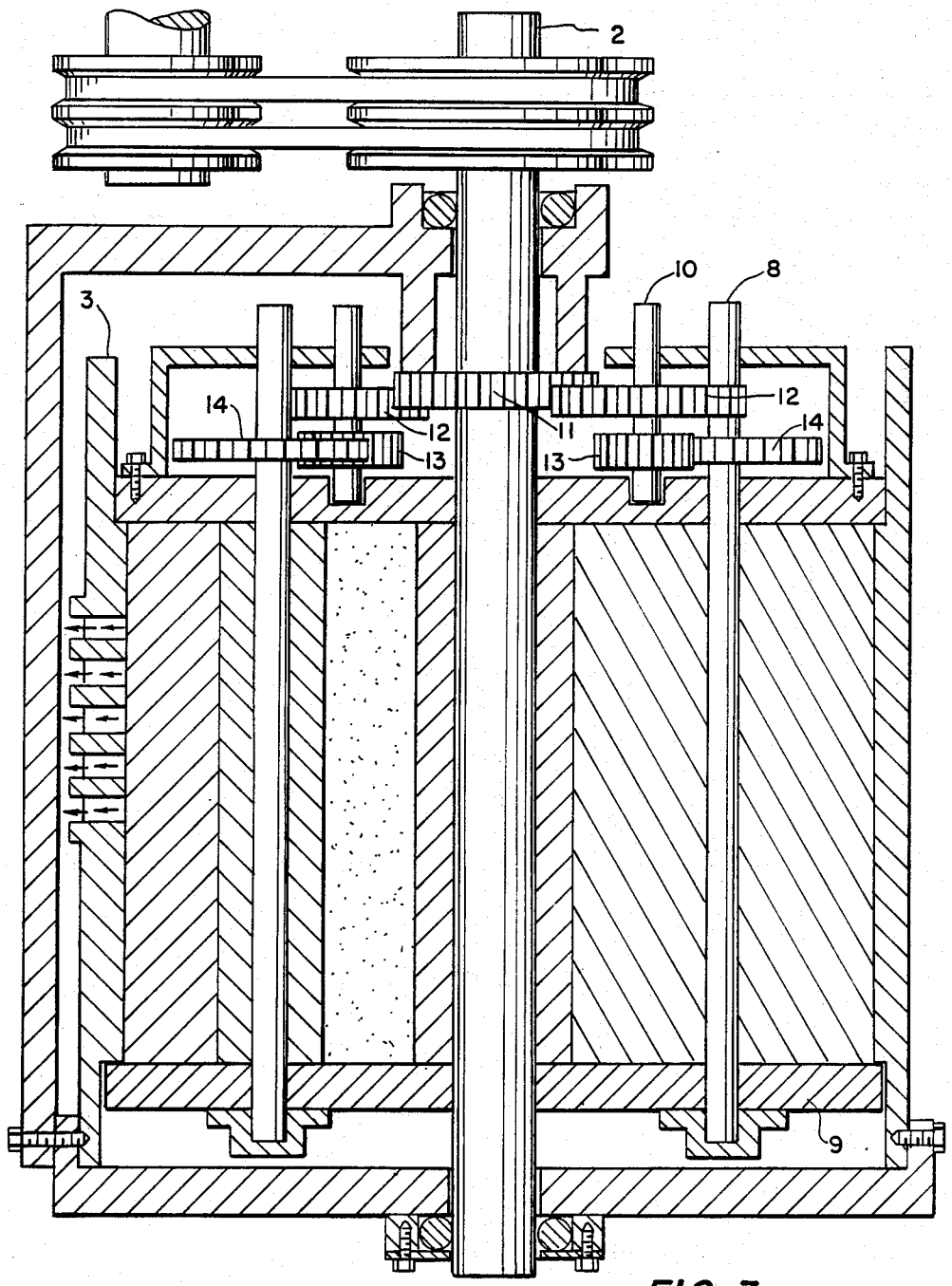
FIG. 3, is a longitudinal section view of the whole machine, showing and the gears of the transmission system.

Such a system may, by way of example, comprise four or seven gears (when one or two planets are used respectively), which are mutually engaged in the manner shown in FIGS. 2 and 3. Gear 11 is fixedly mounted onto the frame of the whole system, and thereby remains still. The axis 2 of the core 1 passes through this gear without touching it. Gear 14 is mounted onto the axis 8 of one planet and is driven by the gear 13, which is mounted together with the gear 12 onto the same auxiliary axis 10. One end of this axis which is also parallel to the other axes 2 and 8, is mounted onto the disc 9 and its other end is mounted onto a laminate of special $\eta$ shape, both ends of which are also mounted onto the same disc, the laminate rotating together with the disc. When the core and the planets rotate in a clockwise direction, the gears 12 and 13 rotate in a clockwise direction as well around their own axis 10, since the gear 11 engaged to the gear 12 remains still as aforesaid. This motion is in turn transmitted via the gears 13 and 14 to the axis 8 as a counter-clockwise motion, i.e. in the opposite direction. Because of the value 1:2 of the gear ratio of gears 11 and 14, we eventually have half a rotation of the axis 8 corresponding to each full rotation of the axis 2. The gears chosen have minimum tolerances. All shafts are preferably mounted onto ball bearings, in order to reduce energy losses.

5. The housing 3

The external appearance of the housing is cylindrical. However, what matters is its internal surface, because it is in its interior that the planets together with the core 1 and two discs 9 rotate. It is because of this reason, that the internal surface of the housing 3 is shaped in a manner such as to comprise the geometrical locus of the points inscribed by the tips of the planets during their rotation. The housing 3 is provided with two openings, one for the introduction and the other for the discharge of the fluid. The housing 3 is mounted onto a frame, whereas the axis 2 of the core 1 is mounted via two laminates onto the housing 3.

Figure 1:
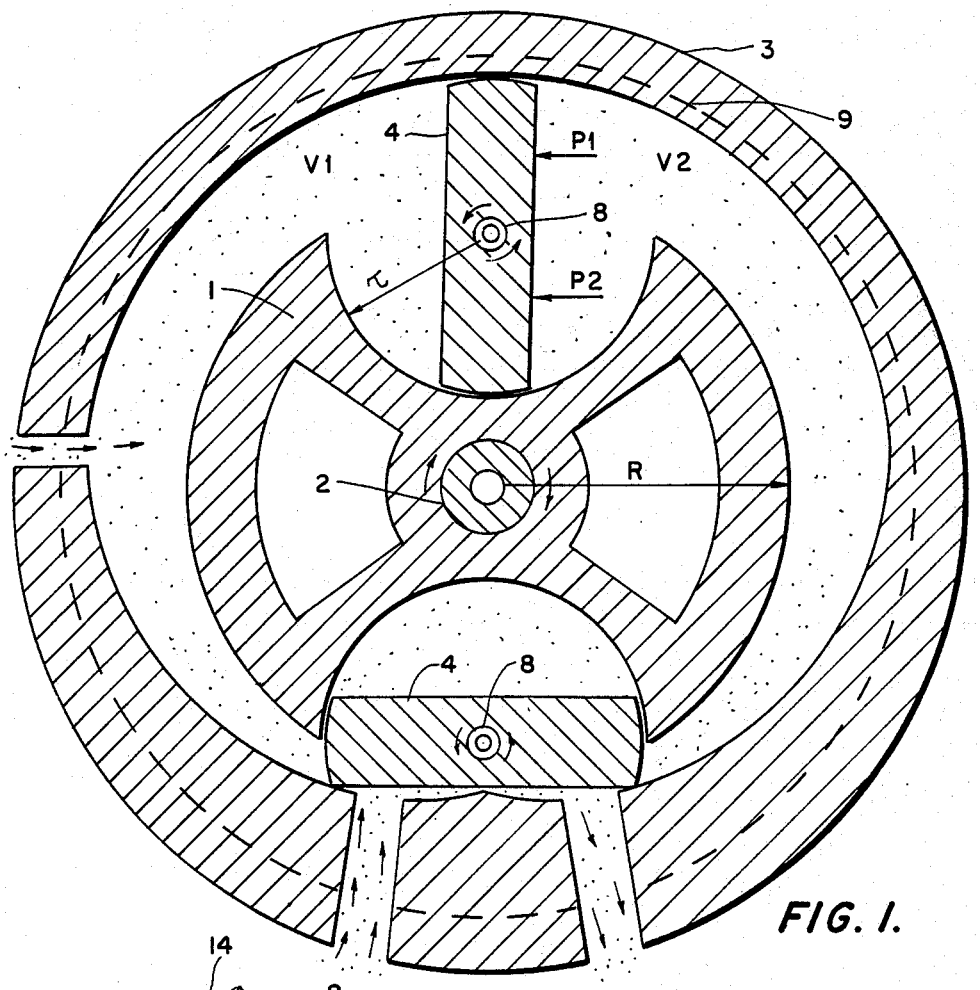
FIG. 1, is a cross section view of the planetic system and its housing.

MODE OF OPERATION OF THE PLANETIC SYSTEM IN VARIOUS APPLICATIONS a. As a liquid or gas pump When via a motor the shaft 2 of the planetic system is rotated e.g. in a clockwise direction, the planets move in the same direction and press the liquid or gas occuping the space V2 (FIG. 1) to the discharge. On the contrary and because of the increasing of the space V1 on the left of the planet, a new amount of liquid or gas in introduced through the inlet of the planetic system.

The process is repeated in each rotation of the shaft 2, irrespective of whether the system comprises one or two planets, and thus in fact there is provided a pump which sucks a liquid or gas (provided at the inlet) in order to compress it towards its discharge.

If the shaft 2 is moved in the opposite (counterclockwise) direction, the outcome will be the same but the positions of the pumps inlet and outlet will be reversed.

The pressures P1 and P2 (FIG. 1) exerted by the fluid onto the respective surfaces of the planet of equal size are equal. This is the reason that the movement of the planets around their axis requires a minimum power, resulting to negligible power losses for this process and elimination of the requirement to make a specially reinforced transmission system.

The flow through the pump will be proportional to the size of its net volume (V1 and V2) and the number of revolutions, whereas the pressure that might be developed depends on the degree of tightness (tolerances at the points of contact of its moving parts) as well as on the strength it has been designed for (i.e. resistance in pressures, torques, etc.).

The discharge of gas pumps should be preferably with a non-return valve, in order to obtain a uniform compression and a limitation of the power losses.

The merits of the above described pump which are of constant volume, compared to similar pumps broadly used in agriculture (for conveying wheat) and in industry, such as for example ROOTS blowers or rotary piston blowers of helicoidal form, are the following:

Higher concetration of power and increased flow rate and pressure for the same volume of machinery.

Uniform compression, which is not obtainable by conventional pumps.

Less friction (or contact) surfaces and ability to run at more revolutions per minute and therefore better efficiency and increased flow rate for the same volume of machinery. Compared to the ROTARY-MULTI-VANE COMPRESSOR type pump, the proposed pump has the advantage of running at more revolutions per minute since it is free of friction surfaces and of providing an increased flow rate and higher efficiency for the same volume of machinery.

Finally, compared to the centrifugal pumps and in particular the multi-stage ones (turbine pumps), broadly used in agriculture for irrigation from deep drillings, the proposed pump is clearly advantageous with respect to the pressure and flow rate provided for the same volume of machinery.

(b) As a Hydraulic motor or Gas motor

If one of the openings of the planetic system is supplied with liquid or gas under pressure, it will continuously press the planets towards the other opening, wherefrom it will be discharged (outlet opening).

The planets (preferably two planets are employed) will in turn lead the core and its axis 2 to a continuous rotational motion, thereby creating a motor. In this case the planetic system operates in precisely the reverse manner than in the case of the pump, i.e it converts the energy supplied in the form of a fluid under pressure into mechanical energy.

It is anticipated that this motor will be advantageous compared to the conventional radial, axial or mixed-flow hydro-turbines, which are broadly used in dams, since almost 100% of the hydraulic energy of a water fall even of a particularly small flow will be used. Furthermore, the proposed motor may also show merits in view of the steam turbines or other types of motors operating with liquids or gases under pressure.

c. As a Fluid Flow Meter

Figure 8:
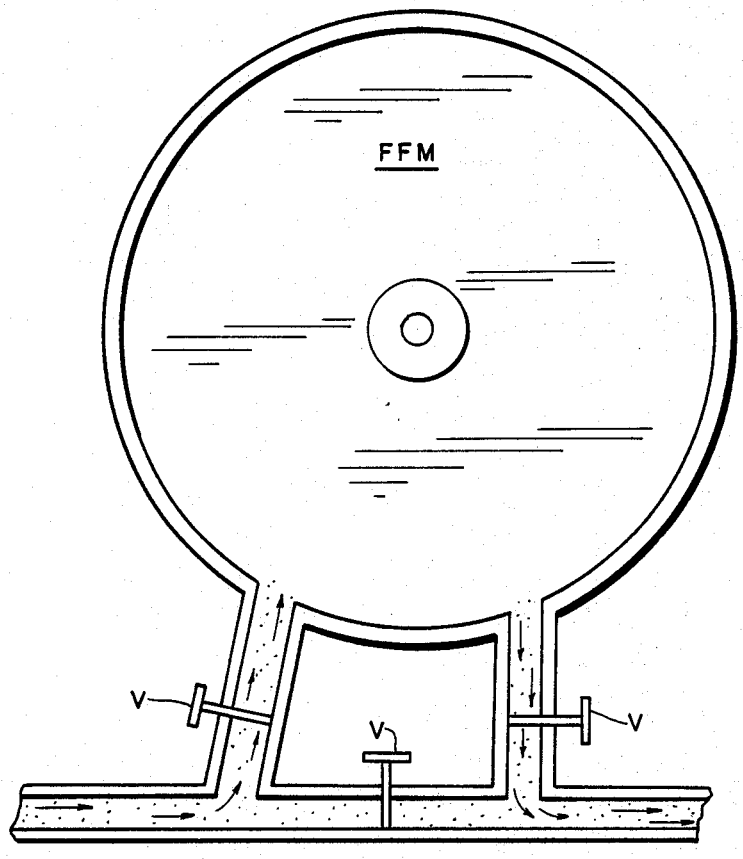
FIG. 8, is a cross section view of a fluid flow meter with a planetic system.

If a portion of the duct transporting liquid or gas is cut off and replaced by the planetic system, connecting each opening of the planetic system to the corresponding free ends of the duct, the planetic system is thereby converted into a liquid or gas flow meter respectively (FIG. 8). Because, the planets being continously pushed at the side of higher pressure, move the entire planetic system, whereby if its axis 2 is connected to a tachometer, it will record the number of revolutions per hour or per minute. Henceforth by multiplying this number of revolutions with the net volume of the planetic system, we eventually obtain the volume of fluid passing through per hour or minute respectively.

It is anticipated that the above fluid flow meter will be better than other conventional fluid flow meters, such as for example of the rotary multivane type, with respect to the level of flow rate (for the same volume of machinery), the efficiency and cost. Cheaper materials, such as plastic PVC, etc. may be used for low pressure applications.

d. As a rotary internal combustion motor

Figure 6:
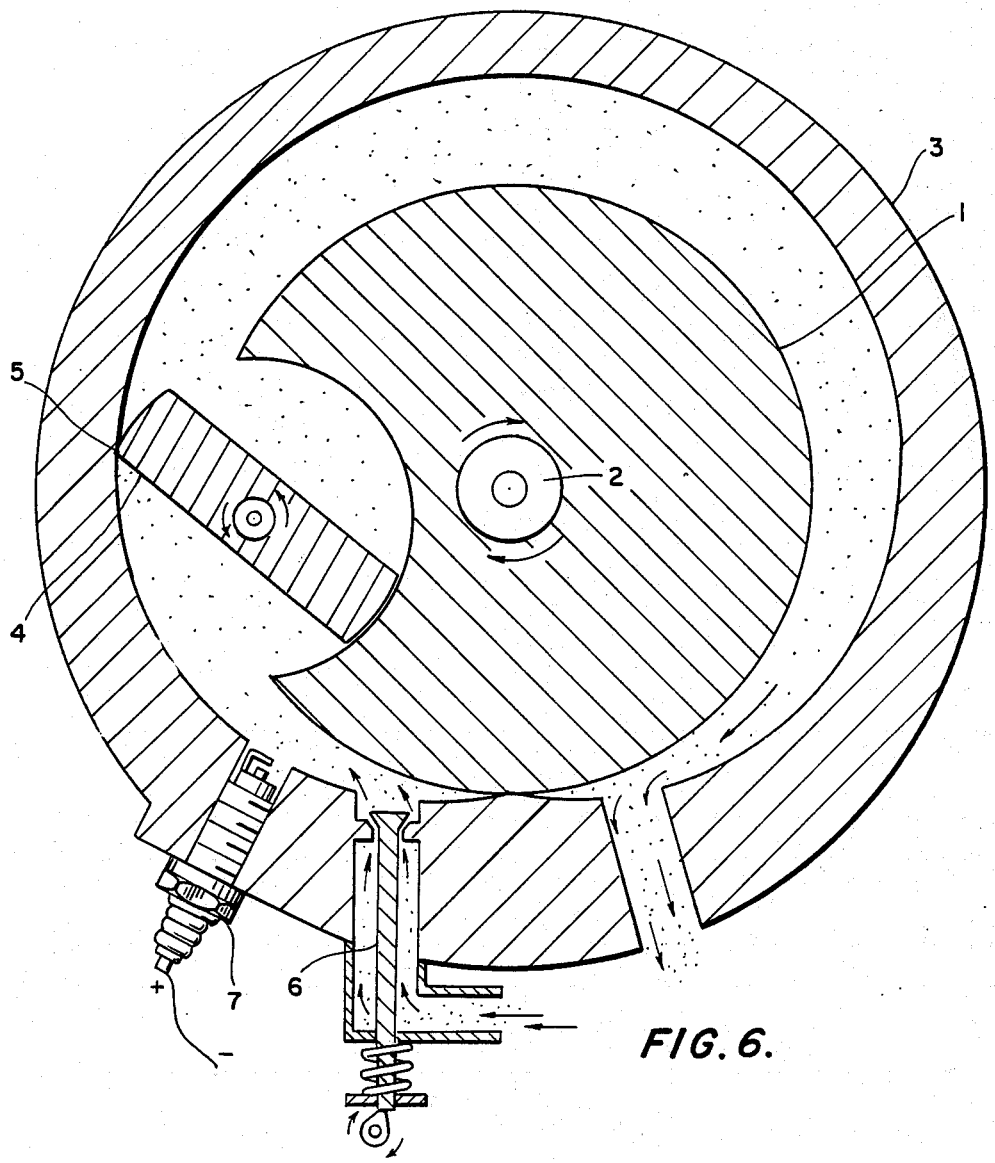
FIG. 6, is a cross section view of a rotary internal combustion motor with planetic system.

The planetic system employing one planet, may be used following certain amendments and addition of special accessories as internal combustion motor (rotary petrol engine) as well. For the implementation of this embodiment, it is necessary to use space V1 (FIG. 6) as space for the introduction of the compressed fuel mixture of petrol and air (at a weight ratio of approximately 1:15), a subsequent ignition and expansion of the same, as described hereiafter. The continous detonations of the mixture result to the heated gases enclosed in space V1 exerting a continous pressure of the planet towards the discharge, thereby causing a rotational motion of axis 2. Thus, eventually the chemical energy of the fuel is converted into mechanical energy. This function may be performed in several manners. By way of example, we can mention the following method:

At the beginning of space V1 and in particular at the entrance to the planetic system we mount a valve 6 which operates in the way that all valves in the up today available petrol engines do, i.e. with a spring reciprocating motion provided by a crankshaft, thereby opening and closing the inlet opening.

An electric spark plug 7 is mounted next to the valve, which is connected in the same way as in the up today available petrol engines, with an electric battery, distributor, multiplier, etc., in order to provide electric spark to the chamber V1 every time and at the right moment, that a fuel mixture is introduced into the chamber V1, i.e. at the moment that the ratio V1:V2 is around 1:10 up to 1:15, this ratio being manifested as the optimum one in practice.

The mixture of petrol and air supplied to the valve 6 under pressure with the assistance of a convetional compressor (pump), having previously being sucked by a ventilaror (carburettor). A planetic system similar to the above mentioned planetic system operating as a pump might be used instead of the abovementioned compressor, its main driving shaft being the shaft of the motor itself. The operating phases of the system are the following:

Opening of the valve 6 and introduction of the fuel mixture under pressure at the time that the planet moves from its position adjacent valve 6 to the position 5, whereat the valve closes and a spark is provided by the electric spark plug. This is followed by ignition, detonation and expansion, i.e. impulse of the planet towards the discharge opening and therefore rotation of the shaft 2.

At the second rotation of shaft 2, we have a repetition of all preceeding phases (suction-ignition-detonation) and furthermore discharge of the combustion gases of the previous phase. Thereby, we observe all four phases of the well known OTTO cycle in each stroke of the shaft 2. However, in order to facilitate cooling of the petrol engine, we can instead of having supply of work in each stroke of the shaft 2 (as in the above), have 2 or 3 strokes, i.e. avoiding the introduction of fuel mixture (keeping the valve 6 closed) during idle strokes, and on the contrary introduce ambient air through a second adjacent valve which will be driven by the same crankshaft, driving the previous valve as well.

Some of the obvious advantages of such a rotary motor over the up today available ones with reciprocating pistons have as follows: Larger concetration of power for the same volume of machinery, less losses of energy due to friction (and reciprocating motion of the pistons-inertia of the mass), better exploitation of the thermal energy of the combustion gases (due to the increase of the ratio of expansion and compression chambers) and thereby a better efficiency. We also have less vibrations and noise.

THE SPECIAL REQUIREMENTS OF THE PLANETIC SYSTEM

Under certain operating conditions and depending on the scope of application, the planetic system must fulfill the following requirements.

1. The tightness of the chambers V1 and V2 must be of a high grade, especially when it is going to be used as an internal combustion motor or a high pressure pump or a fluid flow meter of high accuracy.

Figure 7A:
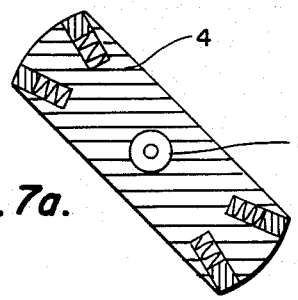
FIG. 7, is a cross section view of two planets with special plates moving within corresponding recessions at the ends of the planets, assistedly by springs.
Figure 7B:
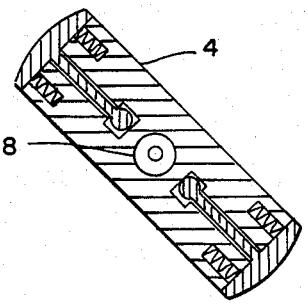

This can be implemented in various ways, such as for example, by mounting special plates at the ends of the planets, which move within corresponding recessions of the planets as shown in FIG. 7 assisted by springs, so that they may continuously maintain contact with the cell's walls. Springs of circular form, similar to those of the presently available petrol engines are also provided onto special recessions on the circumference of the discs 9.

2. Cooling can be realized in several ways, known from the cooling of similar machinery, such as the following:

Mounting of metallic blades onto the exterior of the housing 3 in order to absorb heat assisted by an electric fan.

Circulation of water in the exterior of the housing through specially mounted pipes. The water absorbs the heat of the planetic system and via a circulator transfers this heat to a special refrigerator for its eventual rejection to the surroundings.

The core itself might also be cooled, by means of circulating water or other liquid within it, this water or other liquid being introduced and discharged through the core's shaft 2.

3. Lubricating can be effected via a system delivering lubricating oil in all points of friction (gears, etc.) as well as via the ball bearings supporting the shafts 2, 8 and 10. The case of using a small quantity of lubricant in the fuel mixture (similarly as in double stroke petrol engines) might also be examined in the rotary motor embodiment.

4. Materials of construction

Following the necessary study, the most appropriate materials are selected for the manufacturing of several parts of the planetic system, so that depending on the possible conditions it might have to confront with (pressures, temperatures, torques, etc.) it will show a satisfactory performance, always bearing in mind the relative cost. Thus it is possible besides from metals (steel, iron, aluminum) to employ other lighter and cheaper materials such as plastic PVC, etc., in certain cases and in particular in the embodiments of pumps and fluid flow meters.

5. Size and dimensions of the Planetic System

The size of the planetic system can vary depending on the requirements on the performance of the machinery and also depending on the cost involved. Nevertheless, the dimensions of several parts of the planetic system are calculated in a way such that the full strength and maximum efficiency of the employed material might be manifested. Thus, it is of particular importance that the dimensions (diameter and length) both of the core and the planets and especially the necessary relationship between them (r:R and L) be correctly selected.

I claim:

1. A planetary system (P.S) that can be used as pump, fluid flow meter and motor, comprising, in combination, a housing (3): a cylindrical core (1): means rotatably mounting said core in said housing, said core having at least one peripheral portion engaging one arcuate surface portion of the inner surface of said housing: the inner surface of said housing and a peripheral surface of said core conjointly defining inlet and outlet chambers extending in opposite angular directions from the arcuate surface portion: two discs (9) mounted on the two basements of the core: one or more planets (4) mounted on the two discs: means (as example four gears 11, 12, 13, 14 per planet) interconnecting said cylindrical core and said planets for rotation of said planets on said core, as the latter rotates about its axis, at an angular velocity which is half of the angular velocity of said core and direction of movement of said planets opposite to that of said core: the inner surface of said housing being formed as the loci generated by arbitary points on the circumferences of said planets during rotation of said core: the peripheral contours of said planets having a configuration contact with the inner surface of said housing during rotation of said core: a fluid inlet port in communication with said inlet chamber: and a fluid outlet port in communication with said outlet chamber.

2. Planetary system used as pump, fluid flow meter and motor according to claim 1, wherein said cylindrical core and said planets rotate in opposite angular directions at an angular velocity ratio 2:1, by means of transmission system of motion.

3. Planetary system used as pump, fluid flow meter and motor according to claim 2, wherein said transmission system of motion from the shaft (2) of said cylindrical core to the shafts (8) of said planets is comprising, by way of example, four or seven gears, when one or two planets are respectively employed where the gear (11) around said shaft (2) is mounted on said housing, thereby remaining still: the gears (14) are mounted on said shafts (8) of the planets: and the gears (12 and 13)

are mounted on a common auxiliary shaft (10), which is continuously mounted through a special plate on a said disc (9).

4. A planetary system used as pump, fluid flow meter and motor according to claim 1, wherein said planets have, in cross section view, two curved portions consisting of arcs of a circle of radius (r): the other peripheral contours of said planets having a configuration such that said planets rotate in continuous contact with the arcuate surface portion of the inner surface of said housing (as FIG. 5 shows): said planets being mounted through their axes on said discs (9): said planets being rotated in circular recesses in said cylindrical core, said recesses opening outwardly through the periphery of said core.

5. The planetic system described above, according to claim 1, employed as liquid or gas pump, when the shaft (2) of the pump is connected via an engaging means-pulleys or gears-to the shaft of a motor.

6. The planetic system, according to claim 1, employed as a fluid flow meter alongside a duct transporting a liquid or gas, when suitably connected alongside the said duct and equipped with a tachometer, where the indicated number of revolutions per minute or per hour, multiplied by the net volume of the planetic system gives the flow of the fluid.

7. The planetic system, according to claim 1, employed as a hydraulic or gas motor, when a duct transporting a liquid or gas under pressure is connected to the entrance of the motor, where the said liquid or gas under pressure exerts a continuous, impulse to the planets provided between the inlet and the outlet of the planetic system towards the discharge in order to reach: atmospheric air at ambient pressure, thereby leading to a continuous rotational motion of said shaft (2).

8. The planetic system, according to claim 1, being equipped with special accessories (one or two valves, electric spark plug, petrol ventilator, battery, voltage multiplier and special cooling and lubricating system) employed as a rotary internal combustion engine: providing high grade of tightness to the said inlet and outlet chambers, which elaborate as combustion and expansion chambers, by means of special plates, mounted into corresponding recessions of said planets, and springs of circular form mounted into special recessions at the circumferences of the discs.

* * * * *